United States Patent [19]

Langlie et al.

[11] 4,130,147

[45] Dec. 19, 1978

[54] FUNNEL WITH SPOUT EXTENSION SUPPORT

[76] Inventors: Howard Langlie; Albert T. Berg, Jr., both of Ellendale, Minn. 56026

[21] Appl. No.: 825,918

[22] Filed: Aug. 19, 1977

[51] Int. Cl.[2] ..... B65B 39/00

[52] U.S. Cl. ..... 141/98; 141/333

[58] Field of Search ..... 222/538; 141/199-205, 141/297-300, 331-345, 383-386, 392, 98, 391; 285/DIG. 22; 248/94

[56] References Cited

U.S. PATENT DOCUMENTS

| | | | |
|---|---|---|---|
| 1,426,846 | 8/1922 | Craig | 222/538 |
| 3,927,703 | 12/1975 | Beaubien | 141/333 |

*Primary Examiner*—Houston S. Bell, Jr.

*Attorney, Agent, or Firm*—Stuart R. Peterson

[57] ABSTRACT

A support for a spout extension is molded integrally to the rim of a plastic funnel to accommodate the funnel's detachable spout extension and to facilitate holding of the funnel.

7 Claims, 8 Drawing Figures

FUNNEL WITH SPOUT EXTENSION SUPPORT

BACKGROUND OF THE INVENTION

1. Field of the Invention

This invention relates generally to funnels having detachable spout extensions, and pertains more particularly to a funnel provided with a support for the detachable extension.

2. Description of the Prior Art

The type of funnel disclosed in U.S. Pat. No. 3,927,703, granted Dec. 23, 1975 to Everett E. Beaubien, has been well liked by those who have purchased and used it. However, the removable or detachable spout extension has presented a problem as far as displaying funnels of this design. It has been common practice to stack all types of funnels in an inverted relationship. However, as far as this particular funnel type is concerned, if the spout extension is removed in order to permit stacking, it is apt to get lost or misplaced. Furthermore, when the extension is not held by the funnel, the prospective purchaser would not normally recognize that the funnel comes with an extension unless it is explained to him in some way that it does, either verbally or pictorially.

SUMMARY OF THE INVENTION

Accordingly, one object of the present invention is to provide a support for a spout extension of a funnel in which the support is integral with the funnel itself and which support will enable funnels to be readily stacked and attractively displayed so as to encourage their purchase.

Also, the invention has for an object the provision of a means for supporting a removable spout extension in more than one way, thereby affording the merchant a choice as to how he displays the funnels.

Still further, an object is to enable funnels utilizing detachable spout extensions to be shipped in a compact configuration and displayed in the store without having to attach the extensions or to reorient them from the way in which they were shipped. Stated somewhat differently, the funnels, when practicing our invention, can be stacked at the factory and later displayed when unpacked without change or alteration.

Another object of the invention is to provide a choice for the ultimate customer who purchases a funnel with a detachable spout extension as to how it will be held when detached so that it will not interfere with the storage of the funnel and yet will make the extension immediately available when it is needed. Having the extension support integral with the funnel solves this problem. In other words, a funnel utilizing a detachable spout extension may at times be used without the spout attached to the funnel and at times with the extension attached. However, when practicing the teachings of our invention the user is afforded several choices, any one of which will assure that the extension is readily available when needed.

Still further, an object of our invention is to provide a spout extension support that will not interfere in any way with the normal use of the funnel when the extension is not needed. Actually, it is within the purview of the invention to make the holding of the funnel easier during a pouring operation, the support serving as an added means by which the funnel may be grasped.

Yet another object of the invention is to provide an extension support for a plastic funnel that can be molded integrally to the funnel and at the same time entail little or no increase in the cost of manufacturing the funnel.

Briefly, our invention contemplates a spout support for funnels utilizing a detachable spout extension, such as that described in U.S. Pat. No. 3,927,703, hereinbefore referred to, which will readily hold the spout extension during shipment, while the funnels are subsequently stacked for display purposes and later when the funnels are being used by their respective purchasers without the extension in place. In this regard, the extension support is molded integrally to the rim of the funnel, being in the form of a ring having upwardly extending (when the funnel is inverted) fingers thereon which engage either end of the removable spout extension. The spout extension can alternatively be inserted through the ring by the user when the funnel is not in use and, for example, when hung on a nail extending from a wall, this being in addition to the choices available during display. Additionally, the extension, together with the ring for hanging the funnel, enables the funnel to be more readily held during certain pouring operations.

DESCRIPTION OF THE PREFERRED EMBODIMENT

Figure 1:
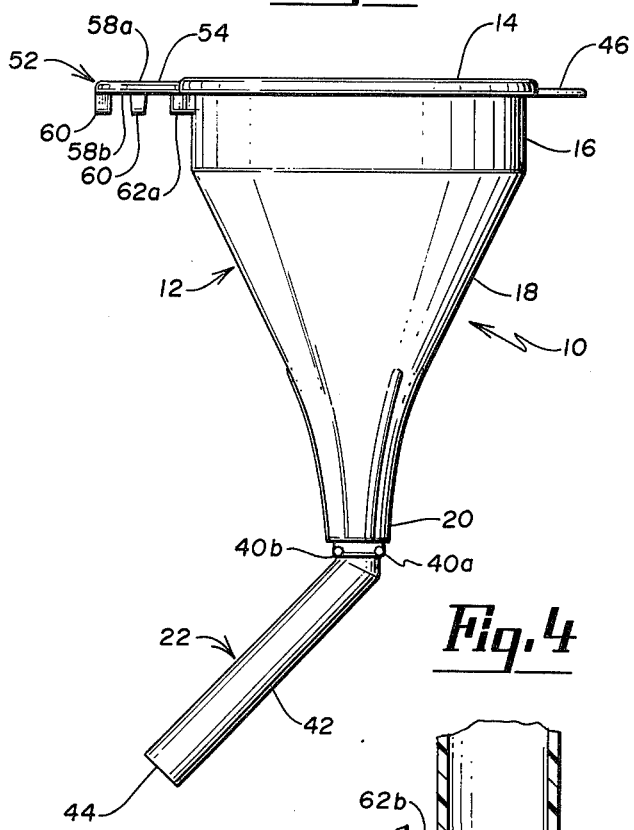
FIG. 1 is a side elevational view of a funnel utilizing the teachings of our invention, the spout extension being depicted in the position it assumes during actual use.
Figure 8:
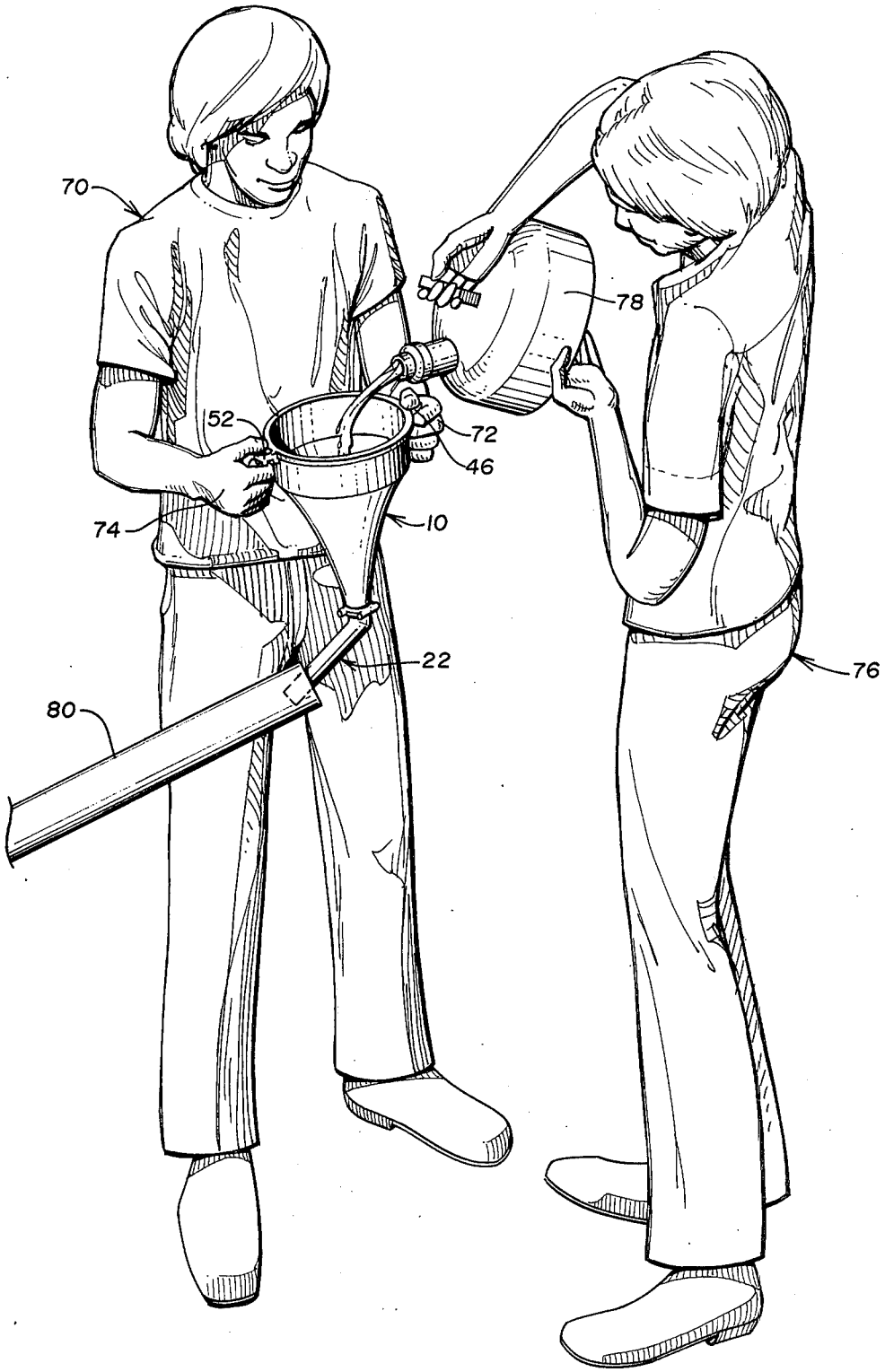
FIG. 8 depicts the funnel in actual use with the extension support facilitating the holding of the funnel.

In order to provide a basis for a better appreciation of the invention, reference will first be made to FIGS. 1 and 2 in which the all-plastic (such as polyethylene) funnel, denoted generally by the reference numeral 10, is depicted in the position it would assume when in actual use (FIG. 8, for example). As illustrated, the funnel 10 includes a body 12 having a rim or inlet end 14 at the top. Beneath the rim 14 is a body 12 having a cylindrical band portion 16 and beneath that a lower tapered portion 18 narrowing down to a relatively small outlet or discharge end 20. At this stage, it should be recognized that the funnel 10 as thus far described can be used in the form described.

However, since it is planned that a spout extension 22 be used when needed, an annular ledge or shoulder 24 (FIG. 2) is formed within the tapered portion 18, more specifically, adjacent the discharge end 20. Diverging downwardly and slightly outwardly from the ledge or shoulder 24 is a conical sealing surface 26.

The spout extension 22 is formed with a coupling end 28 having an upwardly and inwardly converging sealing surface 30 which complements and snuggly fits against the sealing surface 26. As can be discerned from FIG. 2, a plurality of resilient or inwardly flexible tabs 32 extend upwardly from the upper end of the surface 30, there being a slot 34 between each pair of tabs 32. In practice, four tabs 32 have been found satisfactory. Formed on each tab 32 is a latch or shoulder 36 and extending upwardly and inwardly from each latch or shoulder 36 is a sloping cam portion 38.

Figure 2:
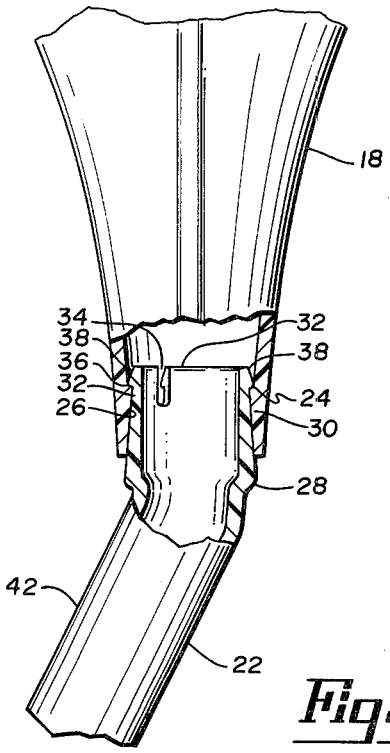
FIG. 2 is an enlarged fragmentary view corresponding to FIG. 1 with a portion of the discharge end of the funnel removed so as to show how the spout extension is removably attached.

Consequently, when the spout extension 22 is forced upwardly into the position shown in FIG. 2, the tabs 32 are compressed inwardly until the latch or shoulders 36 thereon pass the annular ledge or shoulder 24, then snapping outwardly so that the extension 22 is releasably coupled to the discharge end 20. By means of a pair of stops **40*a* and 40*b*, the spout extension 22 is prevented from being forced too far upwardly into the outlet or discharge end 20**.

In addition to the coupling end 28, which is configured as described above, the spout extension 22 further includes an angled tubular section 42 having a slight taper imparted thereto so as to produce a circular discharge end 44 slightly larger in diameter than the end thereof adjacent the coupling end 28. Actually, the taper cannot be discerned from the drawing; however, the discharge end 44 is approximately 1/16 inch larger in diameter than the end of the tubular section 42 adjacent the coupling end 28.

Figure 7:
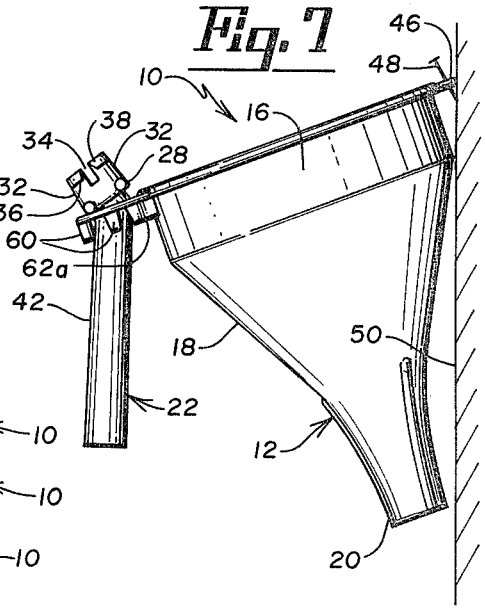
FIG. 7 is a side elevational view of a funnel equipped with our spout extension support during non-use and when hanging from a nail.

Attention is directed at this point to a hangup loop 46. Strictly speaking, this loop 46 does not play a role in the practicing of our invention. Nonetheless, the loop 46 enables the funnel 10 to be hung on a nail 48 in a wall 50 or the like (FIG. 7). When so hung the spout extension 22 can be removed from the body 12, more specifically the discharge end 20, and conveniently and accessibly retained for future recoupling to the end 20 when needed. This will be explained hereinafter.

At this time, attention is directed to a spout extension support 52 integral with the rim or inlet end 14. As can be seen from FIGS. 4–6, the extension support 52 comprises a circular ring 54 having an opening 56 therein. For ease of identification in FIGS. 4–6 reference numerals **58*a* and 58*b* have been employed to indicate the opposite surfaces of the ring 54, the surface 58*a* being uppermost in FIG. 1 and in FIG. 7 but lowermost in FIGS. 4–6. Extending downwardly from the surface 58*b* are three fingers 60. Cooperable with the fingers 60 are lugs 62*a* and 62*b*, these lugs being molded integrally with the cylindrical band portion 16 of the body 12 just beneath (when the funnel is in the position of FIGS. 1 and 7) the rim 14**.

Having presented the foregoing information, the benefits to be derived from a practicing of our invention should be readily apparent. As already pointed out, display of funnels is rendered quite difficult where extension spouts are employed. Whereas a detachable spout extension increases the utility of a funnel, it presents a problem as far as displaying the funnel because the spout extension provides interference with other funnels when endeavoring to compactly stack the funnels.

Because the funnel 10 envisages the detachment of the spout extension 22 in order to use the funnel without the extension, the instant invention makes it possible for the detachable spout extension 22 to be held at one side of the funnel 10 when not in use, both during shipping of the funnels and during the display thereof.

Figure 4:
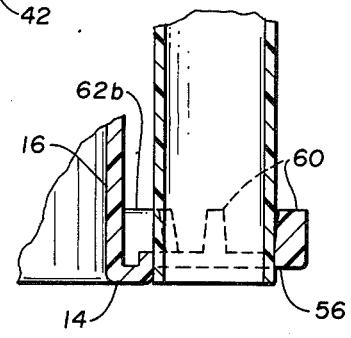
FIG. 4 is an enlarged sectional detail taken in the direction of line 4—4 of FIG. 3.
Figure 3:
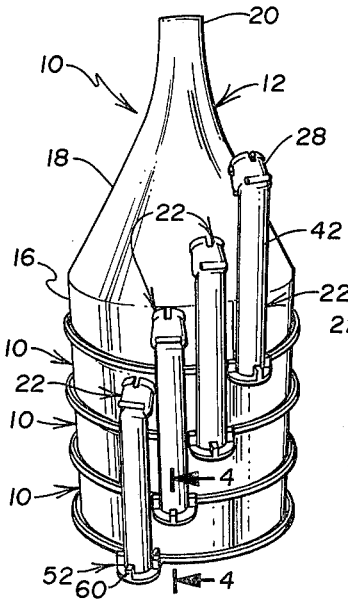
FIG. 3 is a perspective view illustrating a stack of funnels for display, the various spout extensions being supported in one mode.

Accordingly, as far as FIGS. 3 and 4 are concerned, one way of juxtaposing the spout extension 22 is pictured. It will be recalled that the discharge end 44 of the tubular section 42 is somewhat larger (about 1/16 inch) than the end thereof adjacent the coupling end 28. Therefore, the circular opening 56 in the ring 54 is made substantially the same diameter as is the diameter of the discharge end 44 of the spout extension 22. Consequently, the discharge end 44 can be gently forced downwardly when the funnel 10 is inverted, as in FIGS. 3 and 4, to establish a press fit between the slightly larger discharge end 44 of the extension and the ring 54. When inserted into the ring 54, as illustrated in FIGS. 3 and 4, the fingers 60, together with the lugs **62*a* and 62*b*, maintain the tubular section 42** vertical.

Once inserted into the ring 54 the spout extension 22 can be rotated about its own now vertical axis so that the coupling end 28 angles inwardly toward the tapered portion 18 of the body 12. Although the coupling end 28 can be oriented so as to face radially inwardly toward the body 12, the tubular section 42 can be rotated or shifted about its now vertical axis so that each coupling end 28 is not truly radial but angled somewhat to either side of a true radial position, or even at right angles to the radial position appearing in FIG. 3.

In this way, any number of funnels 10, together with their respective spout extensions 22 can be stacked one above the other. In FIG. 3, only four funnels 10 have been illustrated but it will be appreciated that any number can be stacked vertically. Also, while not illustrated, the uppermost funnel 10 can, if the merchant desires, have its particular spout extension 22 snapped into the discharge end 20, in the manner shown in FIG. 2, but, of course, the uppermost funnel in FIG. 3 is inverted with respect to the funnel 10 in FIGS. 1 and 8 (and also FIG. 2). Hence, the display can reflect one funnel 10, the uppermost one, with the spout extension 22 snapped in so as to illustrate to prospective purchasers how the extension is to be used in actual practice.

Figure 6:
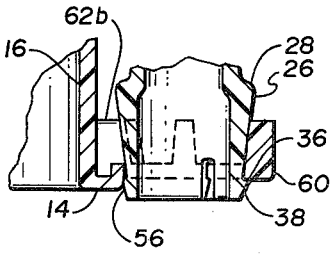
FIG. 6 is an enlarged sectional detail taken in the direction of line 6—6 of FIG. 5.
Figure 5:
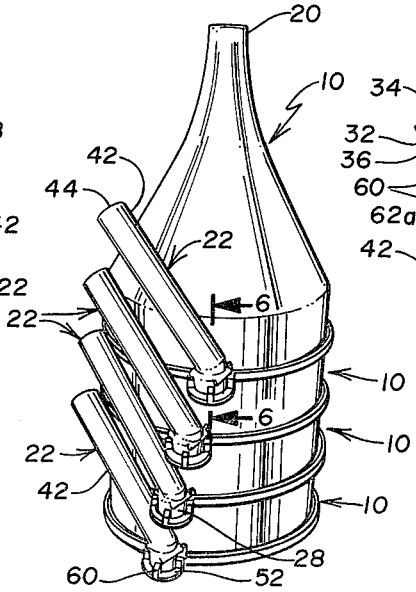
FIG. 5 is a view corresponding generally to FIG. 3 but showing a different way in which the spout extensions can be held.

Although the arrangement pictured in FIGS. 3 and 4 is ample for both shipping and display purposes, nonetheless the invention contemplates a different way of holding the various spout extensions 22. This rearrangement is illustrated in FIGS. 5 and 6. In this situation, especially as can be understood from FIG. 6, the coupling end 28 of each extension 22 is pressed downwardly so that the resilient tabs 32 are flexed inwardly until the cam portions 38 have passed beneath the ring surface **58*b*, the latches or shoulders 36 then springing outwardly so as to resist (but not preclude) detachment. In other words, the shoulders 36 latch beneath the ring 54, more specifically, bearing against the surface 58*b* thereof as is clearly evident in FIG. 6**.

When stacked as shown in FIG. 5, each spout extension 22 can be swiveled so that its tubular section 42 assumes a skewed relation with its particular funnel 10. An effort has been made to portray this situation as far as FIG. 5 is concerned. With the spout extensions 22 rotated so that the tubular sections 42 thereof angle toward the body 12 of each funnel 10, very little space is taken up by the various spout extensions 22, yet they are firmly retained in place much like when in use (FIGS. 1 and 2).

Here again, the uppermost funnel of FIG. 5, although not so shown, can have its particular spout extension 22 snapped into the outlet 20 as it would be in actual use (FIG. 8). In other words, the coupled configuration shown in FIG. 2 can be resorted to and, as with the stacking arrangement of FIG. 3, can provide a showing of the funnel to prospective buyers in the form in which it would be actually used after purchase.

Not only can the two display configurations of FIGS. 3 and 5 be achieved, but once the funnel 10 has been bought, the user can always revert to the manner of holding the particular spout extension 22, as shown in either FIG. 3 or FIG. 5. However, he in all likelihood will find it more advantageous to use the arrangement illustrated in FIG. 7. It will be recalled that the discharge end 44 of the tubular section 42 is somewhat larger in diameter than the end of the tubular section 42 adjacent the coupling end 28. It will also be remembered that the diameter of the discharge end 44 is substantially the same as that of the opening 56. Hence, once the discharge end 44 of a spout extension 22 is pressed downwardly through the ring 54, the end portion of the section 42 adjacent the coupling end 28 is freely movable within the opening 56. However, owing to the enlarged configuration of the end 28, the extension 22 cannot drop through the opening 56 but is retained as illustrated in FIG. 7.

The funnel 10 with the spout extension 22 held by the support 52, as depicted in FIG. 7, can readily be hung on the nail 48 extending from the wall or other surface 50. The loop 46 permits this to be done. Consequently, the spout extension 22 in FIG. 7 is always in readiness for reattachment to the outlet 20. On the other hand, the funnel 10 illustrated in FIG. 7 can be used without the spout extension 22 attached and the holding thereof as illustrated in FIG. 7 does not interfere in any way with the insertion of the end 20 into whatever tank or container that is to be filled with liquid. Of course, when the spout extension 22 is to be used, it is simply pulled upwardly through the opening 56 of the ring 54 and then the coupling end 28 is pressed into the outlet 20 so as to establish the connection shown in FIG. 2. It can then be swiveled or rotated into the most appropriate position.

Although the funnel 10 may be held in various ways, the extension support 52, being diametrically opposite the loop 46, facilitates the more secure holding of the funnel during a pouring operation, as is believed evident in FIG. 8. More specifically, a young man 70 is depicted with his left hand 72 grasping the loop 46 and his right hand grasping the support 52. Another young man 76 is tilting a can 78 of gasoline and is pouring its contents into the funnel 10 so that the gasoline passes through the spout extension 22 into the upper end of an inclined pipe or tube 80 leading to a gas tank (not shown). The firm grasp made possible by the loop 46 and support 52 minimizes the chance of the person 70 inadvertently dropping the funnel 10 during the pouring operation, which is important when handling flammable, toxic or extremely hot liquids. It will be appreciated that the pipe 80 is only symbolic of a number of situations where it is more effectual for one person to hold the funnel 10 and a second person to pour the liquid. Thus, while the primary purpose of the support 52 is to hold the spout extension 22, as illustrated in FIGS. 3–7, the support 52 has the secondary advantage depicted in FIG. 8.

Therefore, it will be recognized that our invention does provide considerable versatility which can be advantageous during any of four stages. More specifically, the first stage is to be considered the shipping stage and a compact arrangement can be achieved, either by using the configuration of FIG. 3 or that of FIG. 5, the stacking enabling the various funnels 10 to be compactly packed for shipment. Secondly, and more importantly, when unpacked and ready to be displayed, either of the arrangements pictured in FIGS. 3 and 5 can be employed, the merchant frequently adopting the arrangement used for shipping. Both are not only an attention getting means for increasing sales but keep the particular spout extension 22 with its funnel 10 so that it does not get misplaced or lost. Thirdly, after the funnel 10 has been purchased, the user not only has a choice of having the spout extension 22 held in the fashion shown in either FIG. 3 or in FIG. 5 but he also can elect the arrangement of FIG. 7. And fourthly, it enables the funnel 10 to be more readily and firmly held during a pouring operation.

We claim:

1. In a plastic funnel including a body having a smaller end forming an outlet and further including a spout extension detachably engageable within the smaller end of said body, said spout extension having a coupling end and an angled tubular section forming a circular discharge end remote from said coupling end, a support for the spout extension comprising a ring integral with said body and projecting therefrom, said ring having an opening therein for receiving said discharge end of said spout extension and said discharge end of said spout extension being substantially the same size as said ring opening, and a plurality of angularly spaced fingers on said ring engageable with angularly spaced portions on said discharge end of said extension.

2. A plastic funnel in accordance with claim 1 including a pair of lugs on said body engageable with other spaced portions on said discharge end of said extension.

3. A plastic funnel in accordance with claim 1 in which said coupling end of said spout extension has a plurality of resilient tabs thereon, each tab having a shoulder engageable with one side of said ring.

4. A plastic funnel in accordance with claim 3 in which each tab also has a cam surface thereon for flexing said tabs inwardly to facilitate engagement of said tab shoulders with said one side of said ring, and angularly spaced fingers on said ring being engageable with some of said tabs on said coupling end of said extension.

5. A plastic funnel in accordance with claim 4 including a pair of lugs on said body engageable with another of said tabs on said coupling end of said extension.

6. A plastic funnel in accordance with claim 1 in which said coupling end is detachably engageable in said smaller end of said body and larger than said discharge end, whereby said discharge end can be forced through said ring opening so that said coupling end then prevents the extension from passing completely therethrough.

7. A plastic funnel in accordance with claim 6 in which said tubular section tapers from said discharge end toward said coupling end, said tubular section thereby being smaller adjacent said coupling end.

* * * * *